United States Patent [19]

Horner

[11] 4,212,587

[45] Jul. 15, 1980

[54] COOLING SYSTEM FOR A GAS TURBINE USING V-SHAPED NOTCH WEIRS

[75] Inventor: Michael W. Horner, Pattersonville, N.Y.

[73] Assignee: General Electric Company, Schenectady, N.Y.

[21] Appl. No.: 910,500

[22] Filed: May 30, 1978

[51] Int. Cl.[2] ..... F01D 5/18

[52] U.S. Cl. ..... 416/96 R; 416/97 R

[58] Field of Search ..... 416/95, 96 R, 97

[56] References Cited

U.S. PATENT DOCUMENTS

| | | | |
|---|---|---|---|
| 3,446,481 | 5/1969 | Kydd | 416/96 |
| 3,658,439 | 4/1972 | Kydd | 416/97 |
| 3,804,551 | 4/1974 | Moore | 416/97 |
| 3,856,433 | 12/1974 | Grondahl et al. | 416/97 |
| 4,017,210 | 4/1977 | Darrow | 416/97 |

*Primary Examiner*—Everette A. Powell, Jr.
*Assistant Examiner*—A. N. Trausch, III
*Attorney, Agent, or Firm*—Jerome C. Squillaro

[57] ABSTRACT

An improved cooling system for a gas turbine is disclosed. A plurality of V-shaped notch weirs are utilized to meter a coolant liquid from a pool of coolant into a plurality of platform and air foil coolant channels formed in the buckets of the turbine. The V-shaped notch weirs serve to desensitize the flow of coolant into the individual platform and air foil coolant channels to design tolerances and non-uniform flow distribution.

9 Claims, 5 Drawing Figures

COOLING SYSTEM FOR A GAS TURBINE USING V-SHAPED NOTCH WEIRS

BACKGROUND OF THE INVENTION

The present invention is directed towards an improved cooling system for a gas turbine. More particularly, the present invention is directed towards an improved cooling system which utilizes a plurality of V-shaped notch weirs for metering coolant into a plurality of platform and air foil distribution channels located in the buckets of the gas turbine.

The cooling system of the present invention is utilized in connection with the gas turbine of the type including a turbine disk mounted on a shaft rotatably supported in a casing and a plurality of turbine buckets extending radially outward from the disk. Each of the buckets includes a root portion mounted in the disk, a shank portion extending radially outward from the root portion to a platform portion, and an air foil extending radially outward from the platform portion. During operation, the buckets receive a driving force from hot fluid moving in a direction generally parallel to the axis of the shaft and convert this driving force to rotational motion which is transmitted to the shaft via the turbine disk. As the result of the relatively high temperatures of the hot fluid, a significant amount of heat is transferred to the turbine buckets. In order to remove this heat from the bucket structure, the prior art has developed a large variety of open-liquid cooling systems. Exemplary of such systems are U.S. Pat. No. 3,658,439, issued to Kydd; U.S. Pat. No. 3,804,551, issued to Moore and U.S. Pat. No. 4,017,210, issued to Darrow. The disclosures of the foregoing patents are incorporated herein by reference.

Open circuit liquid cooling systems are particularly important because they make it feasible to increase the turbine inlet temperature to an operating range of from 2,500° F. to at least 3,500° F. thereby obtaining an increase in power output ranging from about 100–200% and an increase in thermal effeciency ranging to as high as 50%.

A primary requirement of open circuit liquid cooling systems is that the liquid coolant be evenly distributed to the several platform and air foil distribution channels formed in the bucket. Such a distribution is difficult to obtain as a result of the extremely high buckets tip speeds employed resulting in centrifugal fields of the order of 250,000 G. To obtain an even flow of coolant liquid throughout the several coolant channels, the prior art systems, as exemplified by U.S. Pat. Nos. 3,804,551 and 4,017,210, supra, utilize weir structures which meter the amount of coolant liquid supplied to each individual channel from pools of coolant liquid formed in the platform portion of the bucket. Particularly, these systems introduced liquid coolant into each end of a trough formed in the platform portion of the bucket such that liquid coolant flows in a direction parallel to the axis of rotation of the turbine disk from each end of the trough. The liquid coolant flows over the top of an elongated weir which performs the metering for each channel. In order to perform satisfactorily, it is critical that the top of the prior art weir is parallel to the axis of rotation of the turbine within a tolerance of several mils. If this relationship is not maintained, all of the coolant liquid will flow over the low end of the weir and consequently, some of the coolant channels formed in the platform and air foil of the bucket will be starved for coolant.

BRIEF DESCRIPTION OF THE INVENTION

In order to overcome the foregoing drawbacks of the prior art metering structure, the present invention utilizes a novel coolant distribution channel which supplies a metered amount of coolant to each of a plurality of platform and air foil coolant channels and which is relatively insensitive to design tolerances and non-uniform flow distribution. More particularly, the distribution channel of the present invention comprises:

(1) a water collecting trough extending in a direction generally parallel to the axis of rotation of the rotor disk of the turbine and adapted to collect coolant liquid supplied by shank supply channels formed in the shank portion of the buckets; and (2) a plurality of metering means for distributing coolant liquid from the coolant collection troughs to the platform distribution channels in such a manner that each of the platform distribution channels receives a substantially equal supply of coolant liquid, said metering means including a plurality of V-shaped notch weirs formed in said liquid coolant collection trough along the innermost radial portion of said trough such that the the coolant collected in said trough can flow into said notches when the level of coolant in said trough reaches a sufficient height.

BRIEF DESCRIPTION OF THE DRAWINGS

For the purpose of illustrating the invention there is shown in the drawings a form which is presently preferred; it being understood, however, that this invention is not limited to the precise arrangements and instrumentalities shown.

DETAILED DESCRIPTION OF THE INVENTION

Figure 1:
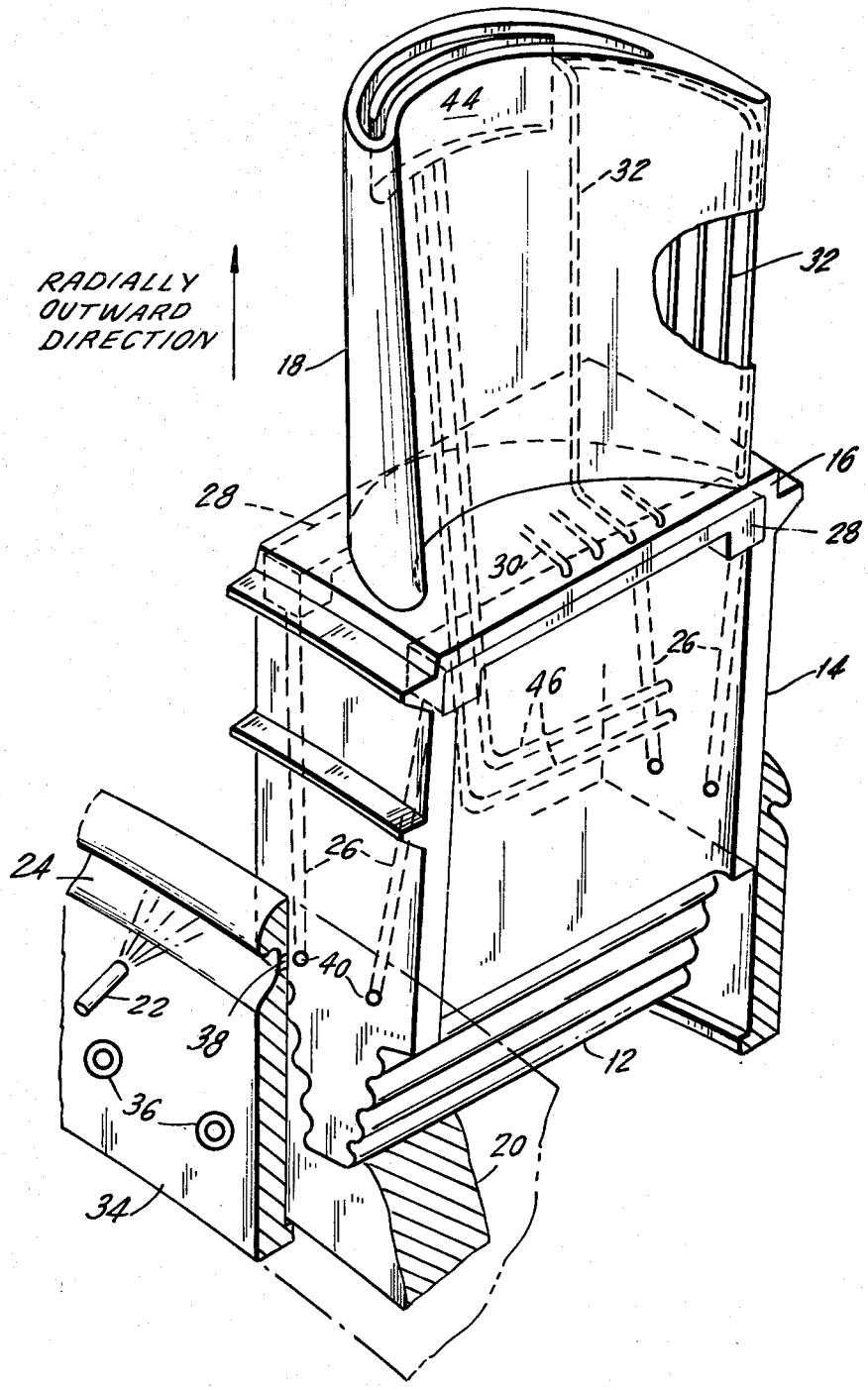
FIG. 1 is a partial perspective view of the improved cooling system of the present invention.
Figure 2:
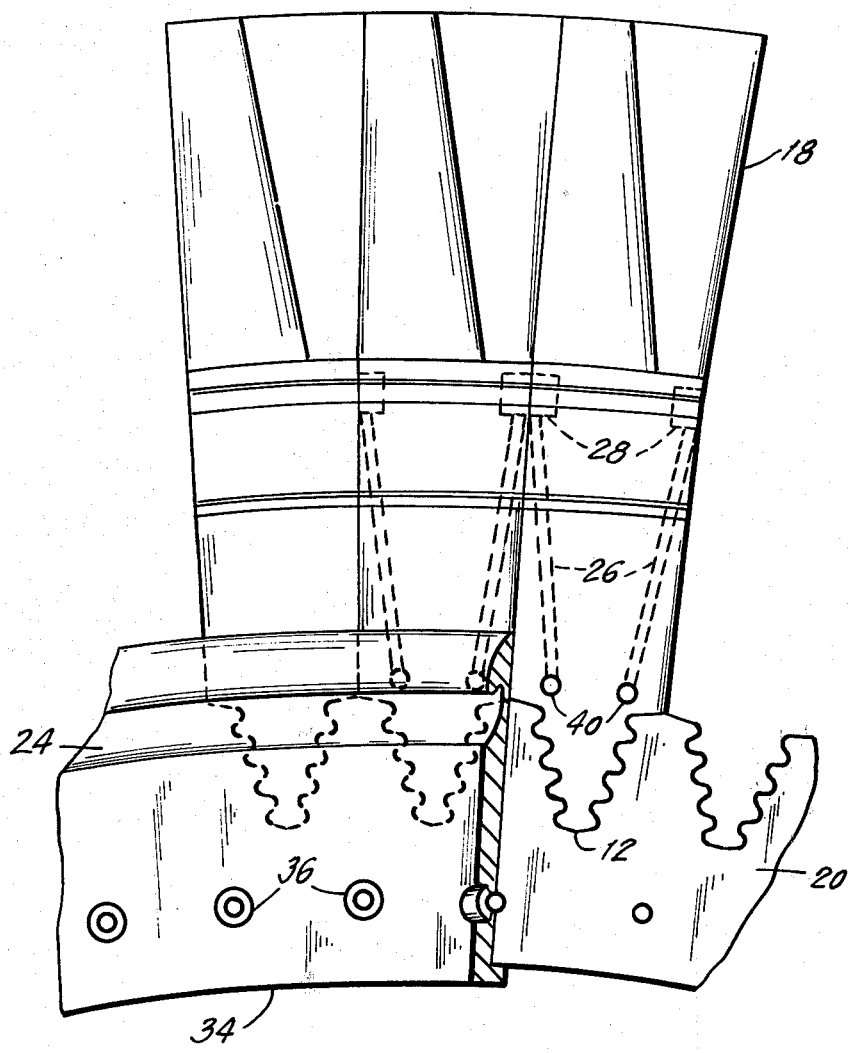
FIG. 2 is a plan view showing the relative location of a plurality of turbine buckets in a gas turbine of the type which may be cooled by the cooling system of the present invention.

Referring now to the drawings, wherein like numerals indicate like elements, there is shown in FIG. 1 a turbine bucket constructed in accordance with the principles of the present invention and designated generally as 10. Bucket 10 includes a root portion 12, a shank portion 14, a platform portion 16 and an air foil 18. Root portion 12 is embedded in a turbine rotor disk 20 which is mounted on a shaft (not shown) rotably supported in a casing (not shown). As will be recognized by those skilled in the art, an actual turbine will include a plurality of buckets 10 located about the entire periphery of the rotor disk 20. The relative placement of several buckets 10 is illustrated in FIG. 2.

As noted above, the present invention is directed towards an improved cooling system for use with gas turbines of the general type illustrated in FIG. 1. The cooling system of the present invention includes a coolant jet 22, which supplies coolant liquid to the turbine system, a coolant collecting channel 24, which distributes the coolant to the individual buckets 10, and a system of coolant channels 2632 which are formed in the bucket 10 and distribute the coolant throughout the surface area of platform 16 and air foil 18. The system of coolant channels 26–32 will be described in greater detail below.

Coolant collecting channel 24 is formed in a 360° ring 34 which is preferably coupled to rotor disk 20 by a plurality of rivets 36. The position of the ring 34 is carefully chosen to insure that passages 38 formed in coolant collecting channel 24 are precisely aligned with matching passages 40 formed in the side wall of the shank portion of bucket 10. Passages 38 are preferably evenly distributed throughout the channel 24 to insure equal coolant flow into each passage 38. By this means, an equal amount of coolant will be supplied to each pair of shank supply channels 26 (formed in shank portion 14) and thereby to each bucket 10. As clearly shown in FIG. 1, a separate ring 34 is located on either side of bucket 10 and supplies an identical pair of shank supply channels 26 on either side of shank portion 14.

Figure 3:
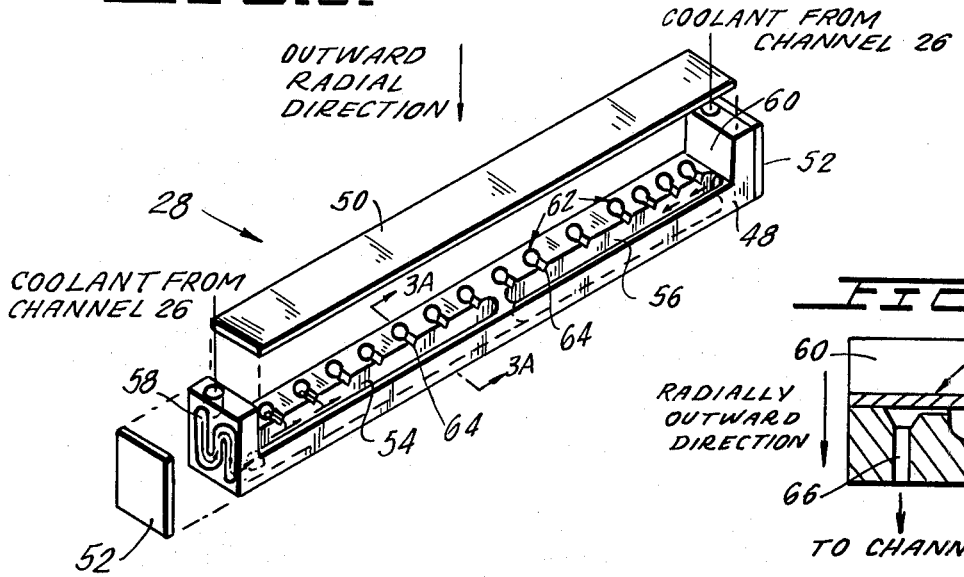
FIG. 3 is a perspective view of a distribution channel forming part of the cooling system of FIG. 1.
Figure 4:
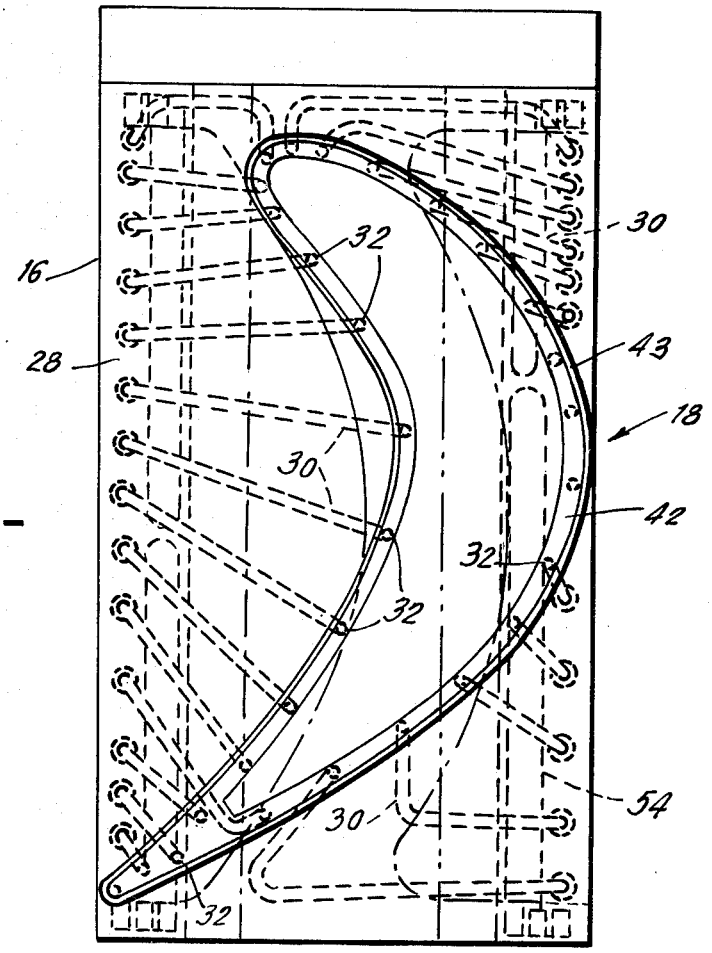
FIG. 4 is a top plan view of the turbine bucket which is illustrated in FIG. 1.

Shank supply channels 26 direct the coolant liquid to a pair of distribution channels 28 located on either side of platform 16. The structure of distribution channels 28 is illustrated in FIG. 3 and will be described in detail below. The coolant liquid supplied by shank supply channel 26 collects in distribution channel 28 and is therefore metered into a plurality of platform coolant channels 30 formed in the platform 16. As best seen in FIG. 4, platform coolant channels 30 extend from distribution channels 28 to a plurality of foil coolant channels 32 formed in the hollow core 42 of foil 18. The foil coolant channels 32 extend in a generally radial direction throughout the outer perimeter of air foil 18 and serve to cool the outer skin 43 of the foil.

As shown in FIG. 1, foil coolant channels 32 terminate in a manifold 44 which collects the coolant for recirculation through the coolant system. Since the coolant absorbs a substantial amount of heat while passing through channels 26 through 32, it is usually in a vaporized form when entering manifold 44. The vaporized coolant is permitted to consolidate in the manifold 44 and presents a liquid cushion to the vaporized coolant exiting the foil coolant channels 32. The consolidated coolant collected in manifold 44 may be discharged either through a pair of steam return channels 46 or through a tip shroud jet (not shown).

Figure 3A:
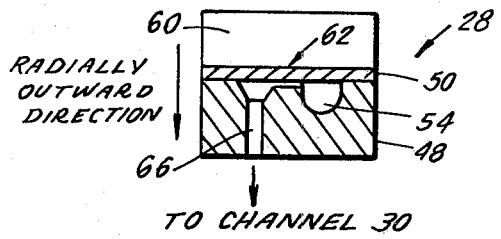
FIG. 3*a* is a cross-sectional view of FIG. 3 taken along lines 3*a*—3*a*.

A detailed structure of distribution channels 28 will now be described with reference to FIG. 3. As shown therein, distribution channel 28 includes a body 48, a top cover 50 and a pair of side covers 52. A pair of troughs 54, 56 are formed in the body portion 48 on either side of the distribution channel 28. As best seen in FIG. 3*a*, troughs 54 and 56 have a generally U-shaped cross-section and extend radially outward towards the tip of air foil 18. Liquid coolant enters each of the troughs 54, 56 from a respective full channel flow trap 58, 60. The flow traps 58, 60 receive coolant from respective shank supply channels 26 located on either side of the bucket 10. Traps 58, 60 serve two purposes: (1) to cushion the sudden decereration of coolant as it approaches the platform 16 and (2) to permit pressurization of the distribution channel 28 (vaporization pressure) without permitting a backflow of vaporized coolant through the supply system.

The channels 54, 56 feed coolant to the platform coolant channels 30 (and thereafter to foil coolant channel 32) via a plurality of metering means 62. Each of the metering means 62 includes a V-shaped notch weir 64, formed along the innermost radial portion of the troughs 54 or 56 associated supply channel 66. V-shaped weirs are used to increase the total water height over the weirs and to thereby desensitize the flow of coolant into the individual coolant channels 30, 32 to design tolerances and non-uniform flow distribution. For a 90° triangular notch, the calculated water height is 0.029″ and for a 60° notch, the calculated water height is 0.036″.

As a result of the foregoing structure, the distribution channel 28 of the present invention provides a highly uniform metering system for supplying coolant to each of the individual coolant channels 30, 32. Additionally, as a result of the use of V-shaped notch weirs, the distribution channel of the present invention is highly insensitive to design tolerances and non-uniform flow distributions.

The manner in which coolant flows through bucket 10 during a typical operation of the gas turbine will now be reviewed. The buckets 10 receive a driving force from a hot fluid moving in a direction generally parallel to the axis of rotation of rotor disk 20. The driving force of the hot fluid is transmitted to the shaft about which the rotor disk 20 is mounted via the buckets 10 and turbine disk 20 causing the turbine to rotate about the axis of the shaft. The high rotational velocity of the rotor creates a substantial centrifugal force which urges the liquid coolant through the bucket in a radially outward direction. As the liquid coolant enters coolant collecting channel 24 it is forced in a radially outward direction along the radially outermost periphery of channel 24 and into the plurality of passages 38. Due to the even spacing of passages 38, an equal amount of coolant will be supplied to each shank supply channel 26 on either side of bucket 10. The centrifugal force created by the rotation of the turbine forces the liquid coolant to move through channels 26 in a radially outward direction into distribution channels 28 where it is collected in the troughs 54, 56. When the level of coolant in the trough reaches the triangular notch weirs 64, the coolant is metered by the weirs 64 and supplied to respective platform channel 30 and thereafter to respective foil coolant channels 32. The coolant continues to advance in a generally radial direction to the tip of foil 18 and is collected in manifold 44. The coolant is normally in a vaporized state at this time and is permitted to consolidate in manifold 44. After consolidation, the coolant is removed from the manifold chamber either via a tip shroud jet or through a pair of steam return channels 46.

The present invention may be embodied in other specific forms without departing from the spirit or essential attributes thereof and, accordingly, reference should be made to the appended claims, rather than to the foregoing specification as indicating the scope of the invention.

What is claimed is:

1. An improved cooling system for a gas turbine of the type including a turbine disk mounted on a shaft rotatably supported in a casing, a plurality of turbine buckets extending radially outward from said disk, each of said buckets including a root portion mounted in said disk, a shank portion extending radially outward from said root portion to a platform portion, and an air foil extending radially outward from said platform portion, said buckets receiving a driving force from a hot fluid moving in a direction generally parallel to the axis of said shaft and the driving force being transmitted to said shaft via said turbine disk, said cooling system comprising:

(A) means located radially inward of said platform for introducing a coolant liquid in a generally radially outward direction into a plurality of shank supply channels formed in said shank portion of each of said buckets, said shank supply channels guiding said coolant liquid into a distribution channel located in said platform of each of said buckets;

(B) platform coolant channels extending from said distribution channels into foil coolant channels located in each of said buckets by which said coolant traverses the surface area of said foil; and (C) said distribution channel comprising:

(1) a liquid coolant collection trough extending in a direction generally parallel to said axis and adapted to collect coolant liquid supplied by said shank supply channels in such a manner as to form a pool of coolant liquid in said trough;

(2) a plurality of metering means for distributing coolant liquid from said pool of coolant liquid into said platform coolant channels in such a manner that each of said platform coolant channels receives a substantially equal supply of coolant liquid, each of said metering means including a V-shaped notch weir formed in said liquid coolant collection trough along the innermost radial portion of said trough such that the coolant collected in said trough can flow into said notches when the level of coolant in said trough reaches a sufficient height.

2. The improved cooling system of claim 1, wherein each of said metering means further includes supply channels adapted to guide coolant flowing into said notch from said notches and into a respective one of said platform coolant channels.

3. The improved cooling system of claim 1, further including a manifold formed in said air foil and adapted to collect coolant exiting said foil coolant channels.

4. The improved cooling system of claim 3, further including a tip shroud jet permitting said coolant to exit from said manifold.

5. The improved cooling system of claim 3, further including a plurality of steam return channels formed in said bucket for permitting coolant located in said manifold to be removed from said manifold and discharged outside of said bucket.

6. The improved cooling system of claim 1, wherein said means located radially inward of said platform comprises:

(A) a 360° ring coupled to said rotor disk and having a 360° coolant collecting channel formed therein;

(B) a first plurality of passages formed in said coolant collecting channel in an area adjacent said shank portions of said buckets; and (C) a second plurality of passages, equal in number to the number of said first plurality of passages, formed in said shank portions of said buckets, each of said second plurality of passages adapted to guide said coolant from a corresponding one of said first plurality of passages to a corresponding one of said shank supply channels.

7. The improved cooling system of claim 6, wherein each of said first passages are formed at equal distances along said coolant collecting channel.

8. The improved cooling system of claim 7, wherein each of said buckets has a first and a second distribution channel formed therein and a pair of shank supply channels formed in each of two opposite sides of said shank portion, each shank supply channel on either side of said bucket feeding coolant liquid to an opposite end of respective ones of said pair of distribution channels.

9. The improved cooling system of claim 1, wherein each of said distribution channels includes first and second troughs formed therein and wherein a plurality of said metering means is associated with each of said pair of troughs.

* * * * *